US006213893B1

(12) United States Patent
Maruko et al.

(10) Patent No.: US 6,213,893 B1
(45) **Date of Patent: *Apr. 10, 2001**

(54) GOLF BALL

(75) Inventors: Takashi Maruko; Hisashi Yamagishi; Atsushi Nakamura; Yutaka Masutani, all of Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/428,787

(22) Filed: Oct. 28, 1999

(30) Foreign Application Priority Data

Feb. 25, 1999 (JP) ..... 11-047724

(51) Int. Cl.[7] ..... A63B 37/06
(52) U.S. Cl. ..... 473/370; 473/374
(58) Field of Search ..... 473/373, 376, 473/377, 378, 370, 354

(56) References Cited

U.S. PATENT DOCUMENTS 790,955 * 5/1905 Davis ..... 473/376
2,376,085 5/1945 Radford et al. .
5,439,227 8/1995 Egashira et al. .
5,490,674 2/1996 Hamada et al. .
5,692,973 12/1997 Dalton .
5,820,485 * 10/1998 Hwang ..... 473/378
5,984,807 * 11/1999 Wai et al. ..... 473/376

FOREIGN PATENT DOCUMENTS 9-285565 11/1997 (JP) .

* cited by examiner

*Primary Examiner*—Jeanette Chapman
*Assistant Examiner*—Raeann Gorden
(74) *Attorney, Agent, or Firm*—Sughrue, Mion, Zinn, Macpeak & Seas, PLLC

(57) ABSTRACT

A golf ball includes a core, an intermediate layer, and a cover. At a boundary between the core and the intermediate layer or at a boundary between the intermediate layer and the cover, convex ribs are arranged in a network pattern on a first layer such that the convex ribs intrude into a second layer adjacent to the first layer. The first layer having the convex ribs is made harder than the second layer which receives the convex ribs, and cutaway portions are formed between the convex ribs.

18 Claims, 6 Drawing Sheets

OCTAHEDRON

OCTAHEDRON

ICOSAHEDRON

GOLF BALL

BACKGROUND OF THE INVENTION

1. Field of the Invention

The present invention relates to a multi-layer solid golf ball comprising a core, an intermediate layer, and a cover. More particularly, it relates to a golf ball in which, at a boundary between a core and an intermediate layer or at a boundary between the intermediate layer and a cover, convex ribs are formed on one of the adjacent layers such that the convex ribs intrude into the other layer.

2. Related Art

Various techniques have been studied and proposed for increasing travel distance of a golf ball and providing a player with an excellent feel upon hitting the golf ball (hereinafter may be called "hit feel"). Especially in a golf ball having a solid core and a cover, the hardness and size (diameter and thickness) of the core and the hardness and size of the cover are adjusted for such purposes.

For example, U.S. Pat. No. 5,439,227 discloses a three-piece golf ball which has a solid core, an inner cover, and an outer cover and in which the outer cover is made harder than the inner cover. Also, U.S. Pat. No. 5,490,674 discloses a three-piece golf ball which has inner and outer solid cores covered with a cover and in which the inner solid core is made harder than the outer solid core.

In the above-described golf balls, the boundary surface of each layer is generally a smooth spherical surface having neither projections nor depressions. However, U.S. Pat. Nos. 2,376,085 and 5,692,973 disclose a golf ball which has on its solid core projections for preventing eccentricity of the solid core, which eccentricity could otherwise arise when a cover is formed around the core through injection molding.

The projections on the solid core of the above-described golf ball are designed to substitute support pins used in an injection molding process, and the effect obtained by the shape of the support-pin-shaped projections is not utilized to improve the performance of the golf ball. In other words, the inventions of U.S. Pat. Nos. 2,376,085 and 5,692,973 relate to a technique for preventing eccentricity of the solid core and preventing mixture of a different material into the cover. According to the technique, by employment of the same material as used for the cover, projections are formed on the core surface such that the cover has a uniform thickness, and the projections and the cover are thus united. As described above, the projections are not designed to improve the performance of the golf ball.

Also, Japanese Patent Application Laid-Open (kokai) No. 9-285565 discloses a two-piece golf ball which has projections and depressions between a solid core and a cover, between two adjacent layers of a multi-layer solid core, or between two adjacent layers of a multi-layer cover. The two-piece golf ball provides a player with different hit feels, depending on the direction of an external force acting on the golf ball during hitting.

The two-piece golf ball has improved in terms of hit feel provided to a player. However, the travel performance and durability are not satisfactory, and there is room for further improvement.

SUMMARY OF THE INVENTION

In view of the foregoing, an object of the present invention is to provide a golf ball which, at a boundary between a core and an intermediate layer or at a boundary between the intermediate layer and a cover, convex ribs are formed on one of adjacent layers such that the convex ribs intrude into the other layer, which has an improved travel performance and controllability, as compared with a conventional golf ball, and which provides a player with an improved hit feel as compared with a conventional golf ball.

In order to achieve the above object, the present inventors have conducted earnest studies, taking notice that when the effect of the configuration at a boundary between the layers of a golf ball; i.e. the cross-sectional, two-dimensional moment of a member that constitutes each of the convex ribs is increased, the bending strength of the member can be increased with no corresponding increase in hardness.

As a result, the present inventors found the following. When convex ribs are formed on one of adjacent layers such that the convex ribs intrude into the other layer and that the hardness of the layer having the convex ribs is made greater than that of the adjacent layer which receives the ribs, the bending strength of the member—which constitutes the convex ribs—increases because of the effect of the rib shape. As a result, when the golf ball is hit at a relatively high head speed by use of a driver or a like club, the degree of backspin of the golf ball decreases and the travel distance increases accordingly, whereas when the golf ball is hit at a relatively low head speed by use of a short iron or a like club, the hardness of the member does not exceed a level of hardness in conventional golf balls, yielding excellent controllability and providing soft feel.

Moreover, the present inventors have conducted further studies and found that a golf ball in which convex ribs are formed in a network pattern at a boundary between the core and the intermediate layer or at a boundary between the intermediate layer and the cover, and in which a plurality of cutaway portions are formed between the convex ribs has the following advantageous effects:

(a) Travel distance is increased, controllability is improved, and a player is provided with an improved hit feel.

(b) In the case where a second layer is injection-molded around a first layer having the convex ribs, or in the case where the second layer is injection molded to have on its outer surface depressions corresponding to the convex ribs, the cutaway portions serve as passages through which resin flows during the injection molding process, so that the first and second layers can be molded properly, imparting improved symmetry to the golf ball.

The present invention was accomplished on the basis of the above-described findings, and provides a golf ball which comprises a core, an intermediate layer, and a cover, in which at a boundary between the core and the intermediate layer or at a boundary between the intermediate layer and the cover, convex ribs are arranged in a network pattern on a first layer such that the convex ribs intrude into a second layer adjacent to the first layer; and the first layer having the convex ribs is made harder than the second layer which receives the convex ribs; and cutaway portions are formed between the convex ribs.

The golf ball according to the present invention has the following advantageous features:

(i) When the golf ball is hit at a relatively high head speed by use of a driver or a like club, the degree of backspin of the golf ball decreases, and the travel distance increases accordingly.

(ii) When the golf ball is hit at a relatively low head speed by use of a short iron or a like club, the degree of backspin increases, so that excellent controllably is maintained.

(iii) A player is provided with a soft feel when hitting the golf ball with a driver, and is provided with a firm and solid feel when hitting the golf ball with a short iron.

(iv) In the case where the second layer is injection-molded around the first layer having the convex ribs, or in the case where the second layer is injection molded to have on its outer surface depressions corresponding to the convex ribs, the cutaway portions serve as passages through which resin flows during the injection molding process, so that the first and second layers can be molded properly, imparting improved symmetry to the golf ball.

DESCRIPTION OF THE PREFERRED EMBODIMENT

Figure 1A:
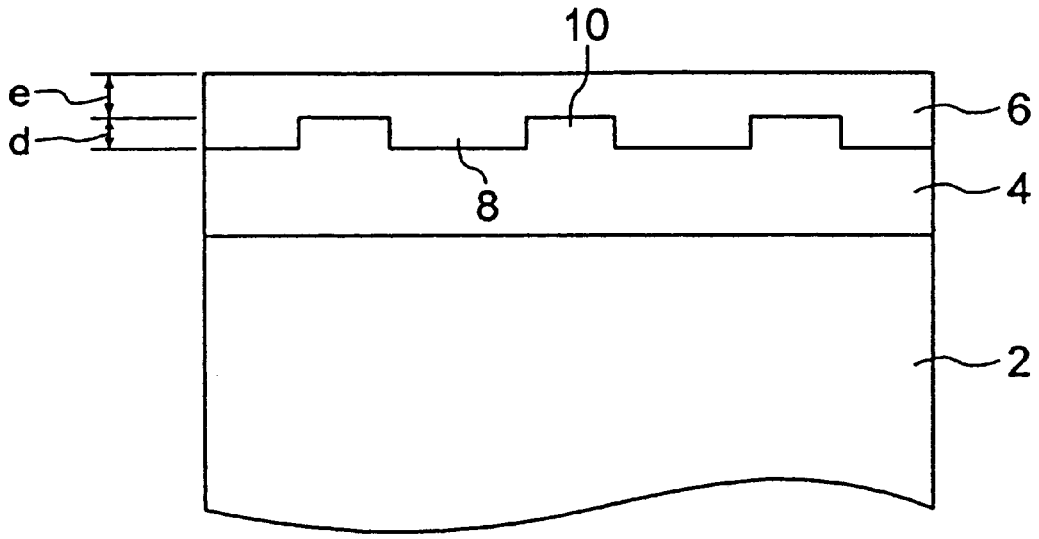
FIGS. 1A and 1B are sectional views schematically showing an exemplary golf ball according to the present invention.
Figure 1B:
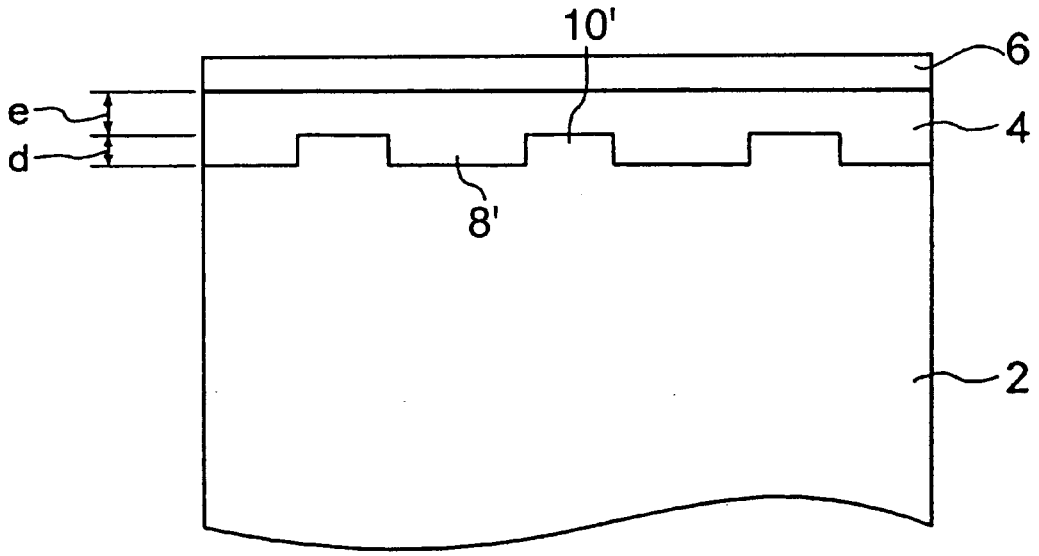
Figure 2:
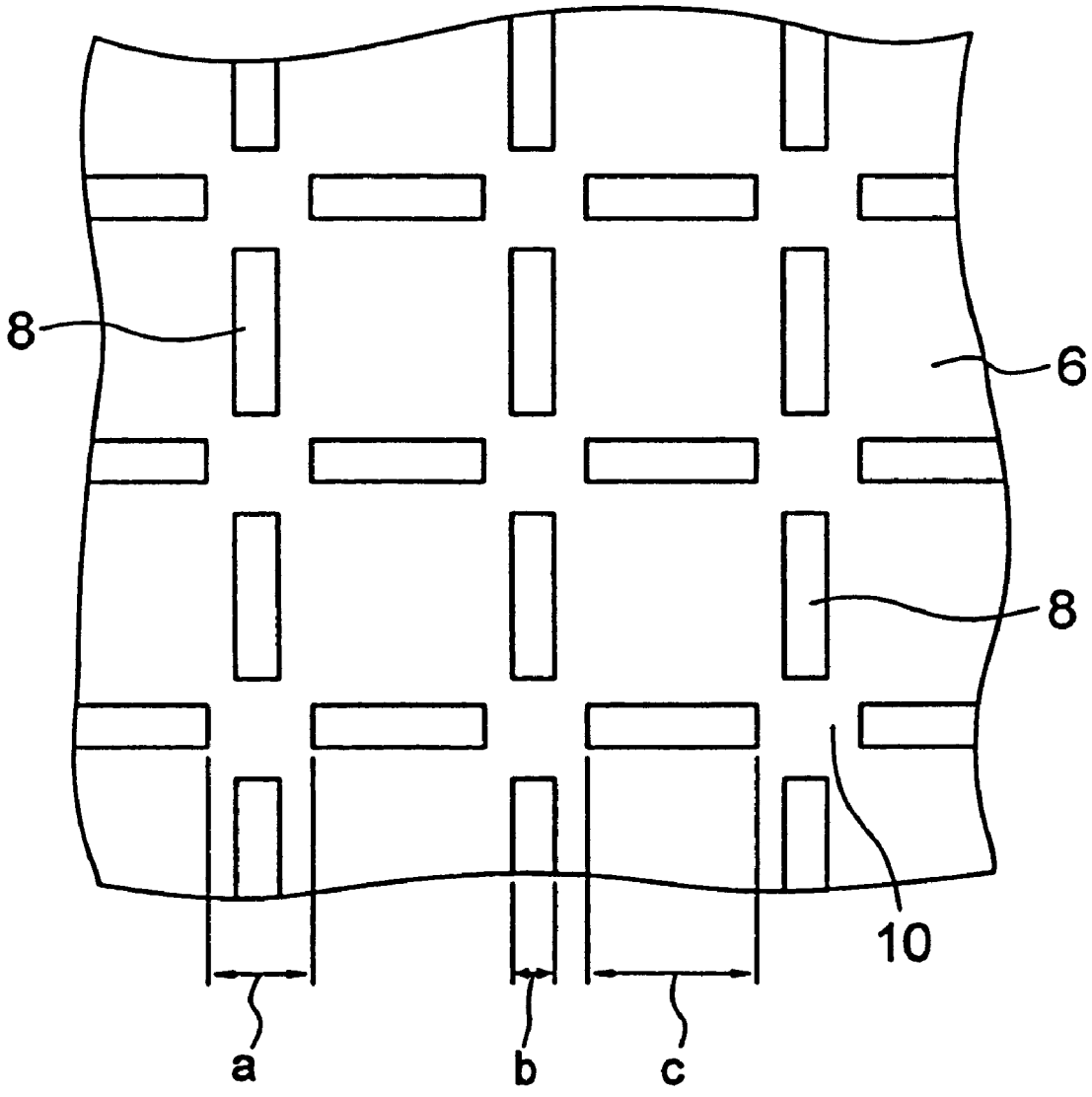
FIG. 2 is a plan view showing the surface of a layer on which convex ribs are formed.

The present invention will now be described in more detail with reference to the drawings. FIGS. 1 and 2 schematically show an example of a golf ball according to the present invention. FIGS. 1A and 1B are cross-sectional views of the golf ball, and FIG. 2 is a plan view of a layer on which convex ribs are formed.

The golf ball according to the present invention composes a solid core 2, an intermediate layer 4 covering the solid core 2, and a cover 6 covering the intermediate layer 4. If necessary, each of the core 2 and the cover 6 may be formed to have a plurality of layers.

Further, in the golf ball of the present invention, at the boundary between the intermediate layer 4 and the cover 6, convex ribs 8 are formed on the inner surface of the cover 6 such that the convex ribs 8 intrude into the intermediate layer 4. In the present invention, in order to prevent eccentricity of the core or catching of air, which would otherwise occur during injection molding, and in order to impart improved symmetry, inwardly projecting ribs are preferably formed on the inner surface of a layer which is provided to suppress deformation of the golf ball. That is, convex ribs are preferably formed on the inner surface of the cover such that the ribs project into the intermediate layer, as shown in FIG. 1A. Alternatively, the ribs are positioned on the inner surface of the intermediate layer such that the ribs 8' project into the core as shown in FIG. 1B. However, alternatively, the convex ribs may be formed on the outer surface of the core so that the ribs project into the intermediate layer or on the outer surface of the intermediate layer so that the ribs project into the cover.

In the golf ball according to the present invention, a first layer having convex ribs is made harder than a second layer which receives the convex ribs. In this embodiment, the first layer having the convex ribs has a Shore D hardness of 58 or greater. The difference in hardness between the first layer having the convex ribs and the second layer which receives the convex ribs is preferably 5 or greater, more preferably 10 or greater, in Shore D hardness. When the difference in hardness between the two layers are less than 5 in Shore D hardness, the difference is too small to yield the effect of the convex rib to a sufficient level.

In the golf ball, the convex ribs 8 are arranged in a network pattern, and cutaway portions 10 in FIG. 1A or 10' in FIG. 1B are formed between the convex ribs 8 or 8'. The cutaway portions function as flow passages through which resin flows during injection molding. In order to enable the cutaway portions 10 to function effectively as the flow passages, the cutaway portions are preferably formed such that the ribs 8 do not intersect each other and do not form any closed circle.

The width a (the distance between two adjacent ribs 8, see FIG. 2) of the cutaway portions 10 is preferably 0.5–10.0 mm, more preferably 2.0–8.0 mm. When the width (a) of the cutaway portions is smaller than 0.5 mm, resin may not flow smoothly through the cutaway portions during injection molding, whereas when the width of the cutaway portions is greater than 10.0 mm, the ribs cannot be designed to have a sufficient length, with the result that the effect of the rib in increasing the strength decreases significantly, and the symmetry of the golf ball deteriorates.

The width (b) of the ribs 8 is preferably 0.3–2.5 mm, more preferably 0.5–2.0 mm. When the width (b) of the ribs 8 is less than 0.3 mm, the ribs 8 become excessively thin, so that the effect of the ribs may becomes insufficient. When the width of the ribs 8 is greater than 2.5 mm, the ribs 8 become excessively thick, so that the hit feel and the symmetry of the golf ball may deteriorate. The length (c) of the ribs 8 separated by means of the cutaway portions 10 is preferably 3.0–15.0 mm, more preferably 4.0–10.0 mm.

Figure 3A:
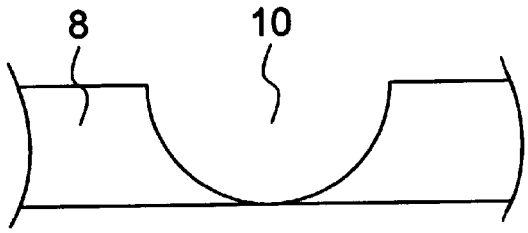
FIGS. 3A, 3B, and 3C are side views each showing the shape of a cutaway portion.
Figure 3B:
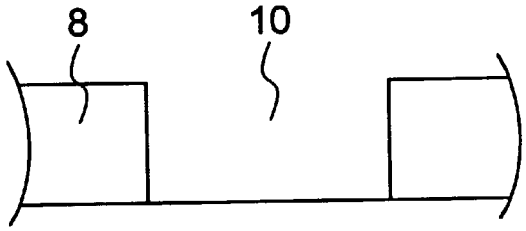
Figure 3C:
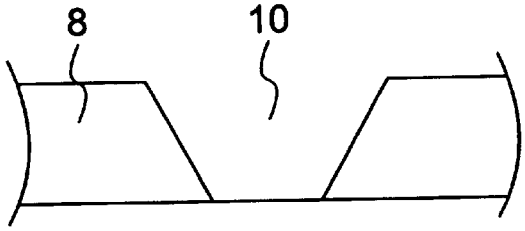

The cutaway portions 10 can be formed in an arbitrary shape through selection of tools used for fabrication of a mold. For example, each of the cutaway portions 10 may have a semicircular cross section (FIG. 3(*a*)), a rectangular cross section (FIG. 3(*b*)), or a trapezoidal cross section (FIG. 3(*c*)), when the rib 8 is viewed from a transverse direction.

The height (d) of the ribs 8 is preferably 0.3–2.5 times, more preferably 0.5–2.0, times the thickness (e) of the first layer having the ribs, the thickness excluding the height of ribs (see FIG. 1). When the ratio is less than 0.3 times, the thickness of the ribs becomes excessively small, so that the effect of the ribs cannot be obtained sufficiently. When the ratio is more than 2.5 times, the thickness of the second layer which receives the ribs becomes excessively large, resulting in occurrence of problems (for example, when the second layer is the intermediate layer, the resilience of the golf ball decreases).

Although the arrangement of the ribs is not limited to the network pattern, the ribs are particularly preferably formed in arrangement (1) or (2) described below. When one of these arrangements is adopted, a high degree of symmetry is realized, and molding is simplified.

Figure 4:
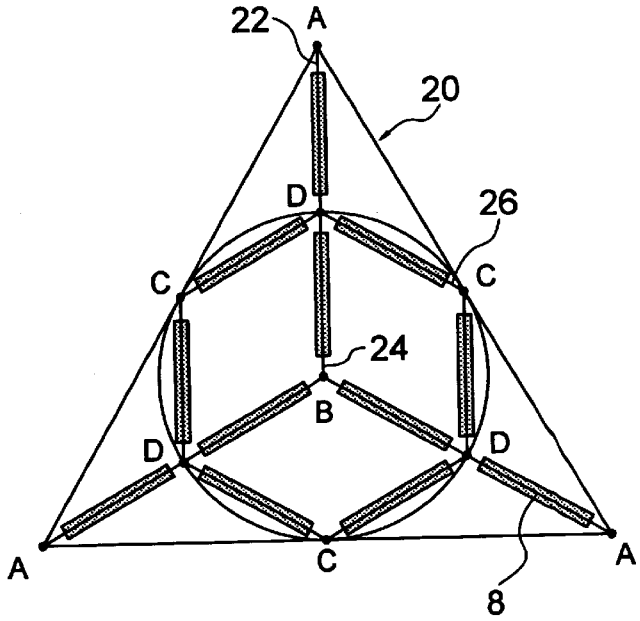
FIG. 4 is an explanatory view showing an example in which ribs are arranged in a network pattern.
Figure 5:
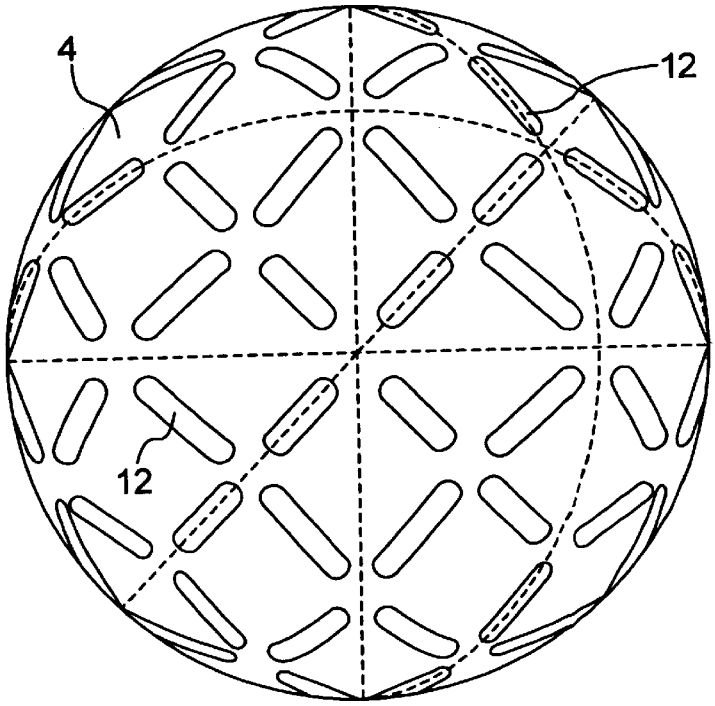
FIG. 5 is a plan view showing an example in which the outer surface of an intermediate layer has depressions corresponding to ribs formed on the inner surface of a cover.

Arrangement 1: As shown in FIG. 4, the first layer having ribs assumes the shape of a regular octahedron. When, in each spherical triangle 20, each apex is represented by A, the center (inner center; the center of an inscribed circle) is represented by B, the midpoint of each side is represented by C, and the midpoint of a line connecting the center B and each apex A is represented by D, the rib 8 is formed along each of a line 22 between point A and point D, a line 24 between point B and point D, and a line 26 between point C and point D. FIG. 5 shows a specific example of Arrangement 1, in which depressions 12 corresponding to ribs formed on the inner surface of the cover are formed on the outer surface of the intermediate layer 4 in accordance with Arrangement 1.

Figure 6:
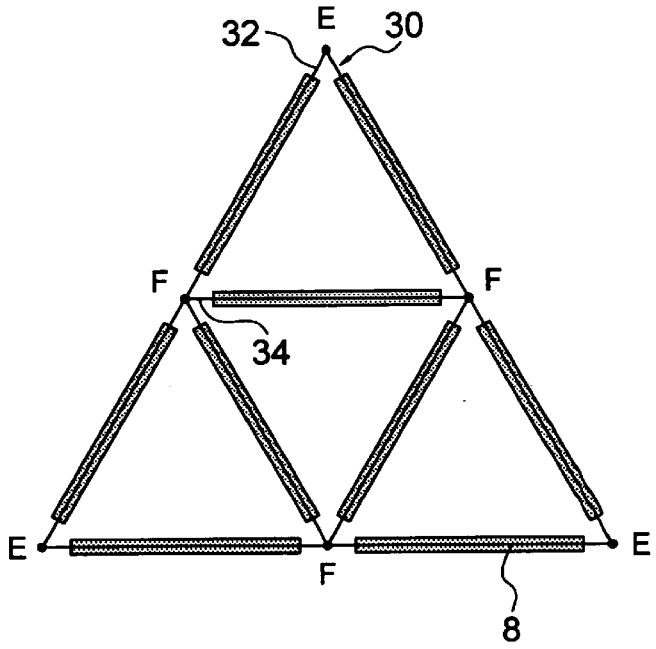
FIG. 6 is an explanatory view showing an example in which ribs are arranged in a network pattern.
Figure 7:
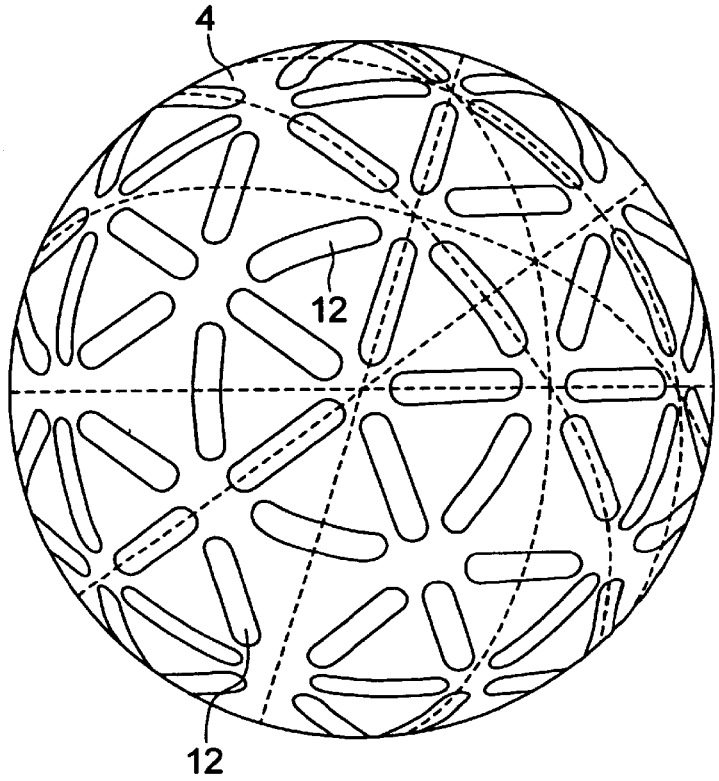
FIG. 7 is a plan view showing an example in which the outer surface of an intermediate layer has depressions corresponding to ribs formed on the inner surface of a cover.

Arrangement 2: As shown in FIG. 6, the first layer having ribs assumes the shape of a regular icosahedron. When, in each spherical triangle 30, each apex is represented by E and the midpoint of each side is represented by F, the rib 8 is formed along each of a line 32 between point E and point F and a line 34 between point F and another point F. FIG. 7 shows a specific example of Arrangement 2, in which depressions 12 corresponding to ribs formed on the inner surface of the cover are formed on the outer surface of the intermediate layer 4 in accordance with Arrangement 2.

Figure 8:
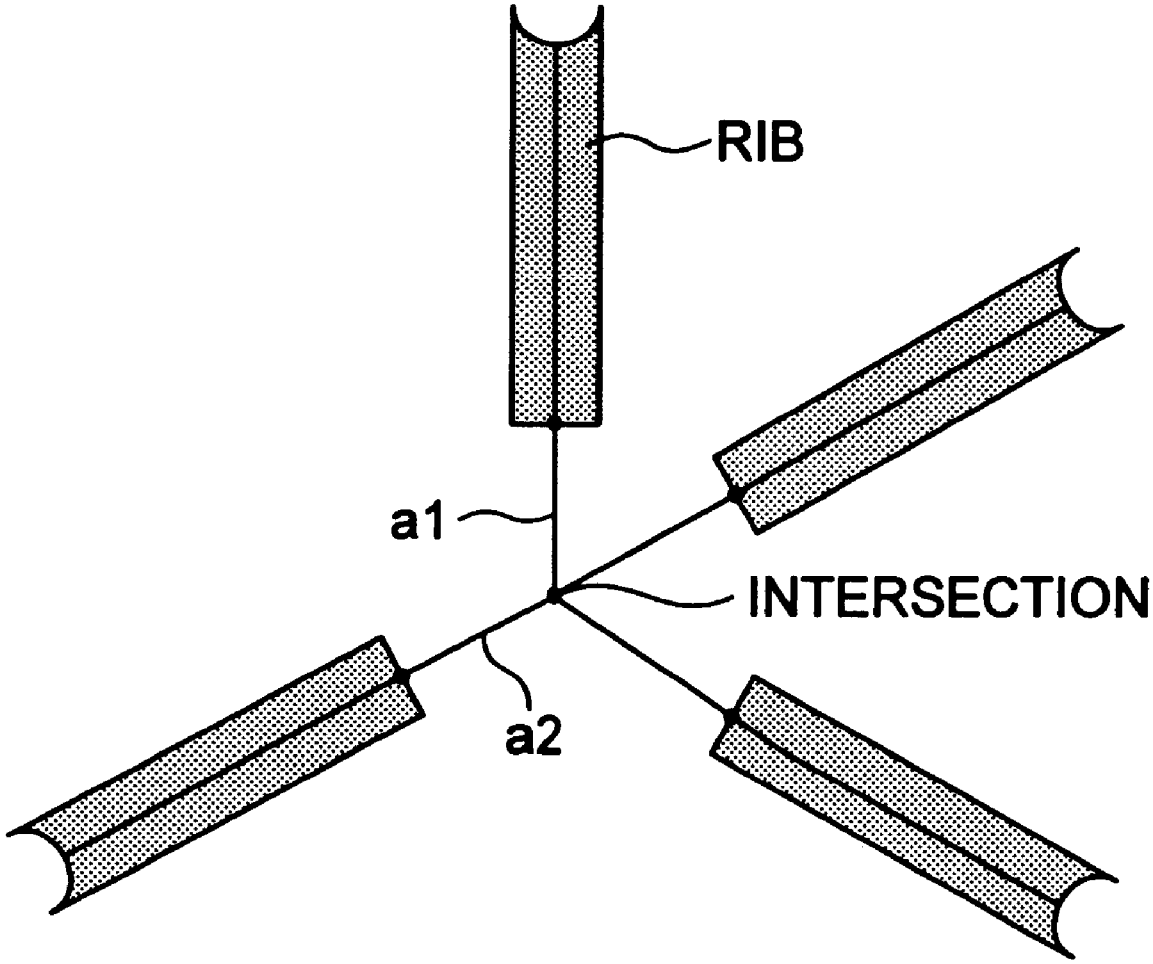
FIG. 8 is an explanatory view showing a method of determining the width of a cutaway portion when the axes of adjacent ribs do not form a straight line.

When the axes of adjacent ribs do not form a straight line as shown in FIGS. 4 and 6, the width (a) of the cutaway portions 10 (the distance between adjacent ribs 8) is a distance as measured through the intersection between the axes of the adjacent ribs 8, as shown in FIG. 8. That is, the width (a) of the cutaway portions 10 is the sum of distances a1 and a2.

Next, the composition of each layer of the golf ball according to the present invention will be described. In the golf ball, the solid core is formed of a base rubber material such as 1,4-cis-polybutadiene, polyisoprene, natural rubber, or silicone rubber, among which 1,4-cis-polybutadiene is particularly preferred, because 1,4-cis-polybutadiene can improve resilience.

A zinc or magnesium salt of an unsaturated fatty acid such as zinc methacrylate and zinc acrylate, or a ester compound such as trimethylpropane methacrylate may be added, as a cross-linking agent, to the base rubber material, and among them, zinc acrylate is particularly preferred, because zinc acrylate can increase resilience. These linking agents are preferably incorporated in an amount of 15–40 parts by weight based on 100 parts by weight of the above-described base rubber material. Also, a vulcanizing agent may be added in an amount of 0.1–5 parts by weight based on 100 parts by weight of the base rubber material.

If necessary, zinc oxide and/or barium sulfate may be added to the base rubber material, as an antioxidant or a filler for adjusting specific gravity. The amount of the filler is 5–130 parts by weight based on 100 parts by weight of the base rubber material.

The base rubber material (a rubber composition for the solid core) preferably has the following composition:

| | |
|---|---|
| 1,4-cis-polybutadiene | 100 parts by weight |
| zinc oxide | 5–40 parts by weight |
| zinc acrylate | 15–40 parts by weight |
| barium sulfate | 0–40 parts by weight |
| peroxide | 0.1–5.0 parts by weight |

Desirable vulcanization conditions; temperature: 150±10° C., vulcanization time: 5–20 minutes.

The above-described rubber composition for the solid core is kneaded by use of a conventional mixer (for example, a Banbury mixer, a kneader, or a roll). The thus-obtained compound is molded through injection molding or compression molding employing a mold for the core.

In the present invention, when the convex ribs are formed on the outer surface of the core, preferably the core has a multi-layer structure having an inner core and a single- or multi-layer outer core layer (surrounding layer) covering the inner core, and the convex ribs are formed on the outer surface of the outer core layer. The inner core may be formed from the same rubber composition as the above-described rubber composition for the core. The outer core layer may be formed from a rubber material, but is preferably formed from a resin material such as an ionomer resin; an amide resin such as nylon; a urethane resin; or a polyester elastomer such as Hytrel. The ratio of the thickness (mm) of the outer core layer (the thickness of the outer core layer as measured at a portion where the ribs are not present) to the diameter (mm) of the inner core preferably falls within the range of 1:9–1:72, more preferably 1:11–1:36.

In the thus-obtained solid core, the diameter (when ribs are formed on the core, the height of the ribs is excluded) is preferably 28–38 mm, more preferably 30–37 mm; the Shore D hardness is preferably 20–50, more preferably 25–45; the deformation upon application of a load of 100 kg is preferably 2.5–5.0 mm, more preferably 3.0–4.5 mm; and the weight is typically about 12–35.0 g.

In the golf ball according to the present invention, when the ribs are formed to extend outwardly from the core; that is, when portions of the core intrude into the intermediate layer, the ribs are formed on the surface of the core. The ribs can be integrally molded with the core through ordinary molding employing a mold for the core in which depressions corresponding to the ribs are formed on the inner wall of the cavity. However, the ribs may alternatively be formed separately from the core and then bonded onto the surface of the core.

Subsequently, the core having the ribs is covered with a material for the intermediate layer through injection molding or compression molding (preferably injection molding), so that the ribs intrude into the intermediate layer.

No limitation is imposed on the material of the intermediate layer. Either resin or rubber may be used, but, in view of durability, a resin having a high impact resistance is preferably used. For example, polyester elastomer, polyurethane resin, ionomer resin, styrene elastomer, hydrogenated butadiene resin, or a mixture of these materials can be used for the intermediate layer. Among them, polyester elastomer and polyurethane resin are particularly preferred, and commercially available products such as Hytrel 3078, 4047, and 4767 (products of Toray DuPont) may be used. In this case, the Shore D hardness of the intermediate layer is preferably set to 10–50, more preferably 15–45.

In the present invention, when the ribs are formed to extend inwardly from the inner surface of the cover toward the core; that is, when portions of the cover intrude into the intermediate layer, depressions are formed on the surface of the intermediate layer during molding of the intermediate layer. Specifically, a mold for molding the intermediate layer is fabricated such that projections corresponding to the depressions are formed on the inner wall of the cavity of the mold, and the intermediate layer is molded in an ordinary manner by use of the mold. As a result, the core is covered with the intermediate layer, which has a large number of depressions on its outer surface.

Subsequently, the intermediate layer having the depressions on its surface is covered with a material for the cover through ordinary injection or compression molding (preferably injection molding), so that ribs intrude into the intermediate layer.

No particular limitation is imposed on the cover material, and a known cover material can be used. Examples of the cover material include ionomer resin, polyurethane resin, polyester resin, and balata rubber. However, ionomer resin is preferred; more specifically, commercially available products such as Surlyn (product of DuPont) and Himilan (product of DuPont Mitsui Polychemicals) may be used.

If necessary, titanium dioxide, barium sulfate, or any other suitable material may be added to the cover material for the purpose of, for example, adjustment of the specific gravity. Furthermore, if necessary, an UV absorber, an antioxidant, and a dispersant such as metallic soap may be added to the cover material. The cover may be formed of a single layer made of a single material or from two or more laminated layers made of different materials.

The thickness of the cover is preferably 0.5–4.0 mm, more preferably 1.0–2.5 mm (in the case where the ribs are formed on the cover, the height of the ribs is excluded). The Shore D hardness of the cover is preferably 40–70, more preferably 50–65.

In the thus-obtained golf ball, many dimples are formed on its surface. If necessary, coating, stamping, and other finishing treatments are performed on the surface of the golf ball. The golf ball has a hardness such that when a load of 100 kg is applied to the golf ball, the ball deforms in an amount of 2.6–4.0 mm, more preferably 2.8–3.8 mm. In compliance with the R&A golf rules, the golf ball is formed such that the golf ball has a diameter of 42.67 mm or greater and a weight of 45.93 g or less.

EXAMPLES

The present invention will be specifically described with reference to Examples and Comparative Examples. However, the present invention is not restricted to the Examples. All amounts shown in Table 1 represent parts by weight.

Examples and Comparative Examples

Golf balls of Examples 1–3 and Comparative Examples 1–3 were manufactured as follows. First, a solid core for each golf ball was produced. That is, a rubber composition for the solid core having a corresponding composition shown in Table 1 was kneaded by use of a kneader, and vulcanaized for about 15 minutes at 155° C. within a mold for the core.

Subsequently, a composition for an intermediate layer having a corresponding composition shown in Table 1 was kneaded and injection-molded around the solid core to thereby form the intermediate layer. Subsequently, a cover material having a composition shown in Table 1 was injection-molded around the intermediate layer to thereby form the cover. Subsequently, an ordinary coating was applied to the cover. In this way, the golf balls of Example 1–3 and Comparative Examples 1 and 2 were completed. In the case of the golf ball of Example 3, a cover material having a composition shown in Table 1 was injection-molded directly around the core to complete the golf ball.

The mold used for molding of the intermediate layer in Examples 1–3 and Comparative Example 1 had projections which were formed on the inner wall of the cavity, and thus depressions corresponding to convex ribs were formed on the outer surface of the intermediate layer during molding of the intermediate layer. The cover material intruded into these depressions, and thus convex ribs were formed in the intermediate layer. The thus-formed convex ribs were arranged in a network pattern of the above-described Arrangement 1 (regular octahedron arrangement).

Subsequently, the thus obtained golf balls were evaluated in terms of travel performance and hit feel, in accordance with the method described below. The results are shown in Table 2.

Travel Performance Test

Each golf ball was hit by a swing robot at the below-described speed, and initial speed, travel distance, and spin were measured.

(1) Driver (W#1), head speed: 45 m/s (HS45), loft: 11°

(2) Driver (W#1), head speed: 35 m/s (HS35), loft: 14°

The driver used in the test was a Tour Stage X100 (product of Bridgestone Sport).

Hit-Feel Test

The golf balls were subjected to sensory evaluation test for hit feel in which three professional golfers hit the golf balls with a driver and evaluated hit feel. Evaluation criteria for hit feel are as follows:

◎: Outstanding

○: Excellent

Δ: Good

×: Poor

TABLE 1

| | | Examples | | | Comparative Examples | | |
|---|---|---|---|---|---|---|---|
| | | 1 | 2 | 3 | 1 | 2 | 3 |
| Composition of core | 1,4-cis-Polybutadiene | 100.0 | 100.0 | 100.0 | 100.0 | 100.0 | 100.0 |
| | Zinc acrylate | 24.0 | 25.0 | 27.0 | 24.0 | 27.0 | 27.0 |
| | Zinc oxide | 5.0 | 5.0 | 5.0 | 5.0 | 5.0 | 5.0 |
| | Antioxidant | 0.2 | 0.2 | 0.2 | 0.2 | 0.2 | 0.2 |
| | Barium sulfate | 25.2 | 24.8 | 27.6 | 25.2 | 27.6 | 20.4 |
| | Dicumyl peroxide | 0.9 | 0.9 | 0.9 | 0.9 | 0.9 | 0.9 |
| Composition of intermediate layer | Hytrel 4047 | 100.0 | 100.0 | 100.0 | — | 100.0 | — |
| | Himilan 1605 | — | — | — | 50.0 | — | — |
| | Himilan 1706 | — | — | — | 50.0 | — | — |
| | Barium sulfate | — | — | — | 24.0 | — | — |
| Composition of cover | Himilan 1557 | — | — | — | — | — | — |
| | Himilan 1601 | — | — | — | — | — | — |
| | Himilan 1605 | 50.0 | 50.0 | 50.0 | 50.0 | 50.0 | 50.0 |
| | Himilan 1706 | 50.0 | 50.0 | 50.0 | 50.0 | 50.0 | 50.0 |

Hytrel: product of Toray DuPont, polyester-based thermoplastic elastomer
Himilan: product of DuPont Mitsui Polychemicals, ionomer resin

TABLE 2

| Ball configuration | | Examples 1 3P | 2 3P | 3 3P | Comparative Examples 1 3P | 2 3P | 3 2P |
|---|---|---|---|---|---|---|---|
| Core | Diameter (mm) | 35.3 | 34.5 | 32.7 | 35.3 | 32.7 | 38.7 |
| | Weight (g) | 27.4 | 25.6 | 22.2 | 27.4 | 22.2 | 35.5 |
| | Specific gravity (g/cc) | 1.190 | 1.190 | 1.210 | 1.190 | 1.210 | 1.170 |
| | Hardness (mm) *1 | 4.0 | 3.3 | 2.9 | 3.3 | 3.3 | 3.4 |
| Intermediate layer | Diameter (mm) | 38.7 | 38.7 | 38.9 | 38.7 | 38.9 | — |
| | Thickness (mm) | 1.7 | 2.1 | 3.1 | 1.7 | 3.1 | — |
| | Weight (g) *2 | 35.6 | 35.5 | 36.2 | 35.6 | 36.2 | — |
| | Specific gravity (g/cc) | 1.120 | 1.120 | 1.120 | 1.120 | 1.120 | — |
| | Shore D hardness | 40 | 40 | 40 | 65 | 40 | — |
| Cover | Diameter (mm) | 42.7 | 42.7 | 42.7 | 42.7 | 42.7 | 42.7 |
| | Thickness (mm) | 2.00 | 2.00 | 1.90 | 2.00 | 1.90 | 2.00 |
| | Weight (g) *3 | 45.3 | 45.2 | 45.4 | 45.3 | 45.4 | 45.2 |
| | Specific gravity (g/cc) | 0.970 | 0.970 | 0.970 | 0.970 | 0.970 | 0.970 |
| | Shore D hardness | 65 | 65 | 65 | 65 | 65 | 65 |
| | Rib shape | | | | | | |
| | Width (mm) | 1.00 | 1.50 | 1.00 | 1.00 | — | — |
| | Height (mm) | 1.50 | 2.10 | 3.05 | 1.50 | — | — |
| | Height/thickness *4 | 0.75 | 1.05 | 1.61 | 0.75 | — | — |
| | Cut width (mm) | 3.8 | 4.6 | 3.8 | 3.8 | — | — |
| W#1 HS 45 m/s | Spin (rpm) | 2230 | 2270 | 2300 | 2010 | 2560 | 2720 |
| | Initial speed (m/s) | 63.7 | 63.6 | 63.6 | 63.3 | 63.3 | 63.3 |
| | Carry (m) | 208.1 | 207.4 | 206.8 | 200.8 | 202.7 | 202.3 |
| | Total distance (m) | 230.6 | 228.1 | 227.3 | 223.6 | 223.4 | 221.5 |
| | Hit feel | ⊙ | ⊙ | ⊙ | X | Δ | Δ |
| W#1 HS 35 m/s | Spin (rpm) | 3370 | 3400 | 3510 | 3060 | 3900 | 4010 |
| | Initial speed (m/s) | 50.6 | 50.5 | 50.5 | 50.2 | 50.2 | 50.2 |
| | Carry (m) | 147.2 | 146.8 | 146.3 | 139.9 | 143.8 | 142.3 |
| | Total distance (m) | 160.5 | 160.1 | 159.7 | 153.2 | 156.1 | 154.2 |
| | Hit feel | ⊙ | ⊙ | ⊙ | X | Δ | X |

*1 Deformation upon application of a load of 100 kg
*2 Core + intermediate layer
*3 Core + intermediate layer + cover
*4 Height of a rib/thickness of a layer having the rib, excluding the height of the rib

What is claimed is:

1. A golf ball comprising; a core, an intermediate layer, and a cover, in which at a boundary between the core and the intermediate layer, convex ribs having a length greater than its width are arranged in a network pattern on one of either said core or intermediate layer such that the convex ribs intrude into the other of said core or intermediate layer; and one of either said core or intermediate layer having the convex ribs is made harder than the other of said core or intermediate layer which receives the convex ribs; and cutaway portions defining flow portions through which material flows during molding are formed between opposite ends of the convex ribs.

2. The golf ball according to claim 1, wherein the cutaway portions are formed such that the ribs do not intersect each other and do not form any closed circle.

3. The golf ball according to claim 1, wherein the cutaway portions has a width of 0.5 to 10.0 mm.

4. The golf ball according to claim 1, wherein the ribs have a width of 0.3 to 2.5 mm and a length of 3.0 to 15.0 mm.

5. The golf ball according to claim 1, wherein one of either said core or intermediate layer having the convex ribs has a Shore D hardness of 58 or greater; and the difference in hardness between one of either said core or intermediate layer having the convexe ribs and the other of said core or intermediate layer which receives the convex ribs is 5 or greater in Shore D hardness.

6. The golf ball according to claim 1, wherein the convex ribs are formed on the inner surface of the intermediate layer or on the outer surface of the core.

7. The golf ball according to claim 1, wherein the convex ribs are formed in arrangement such that when a regular octahedron is assumed on one of either said core or intermediate layer having ribs, and when in each spherical triangle of the regular octahedron, each apex is represented by A, the center is represented by B, the midpoint of each side is represented by C, and the midpoint of a line connecting the center B and each apex A is represented by D, the rib is formed along each of a line between point A and point D, a line between point B and point D, and a line between point C and point D.

8. The golf ball according to claim 1, wherein the convex ribs are formed in arrangement such that when a regular icosahedron is assumed on one of either said core or intermediate layer having ribs, and when in each spherical triangle of the regular icosahedron, each apex is represented by E and the midpoint of each side is represented by F, the rib is formed along each of a line between point E and point F and a line between point F and another point F.

9. The golf ball according to claim 1, wherein the ribs have a width of 0.3 to 2.5 times the thickness of one of either said core or intermediate layer having the ribs, the thickness excluding the height of ribs.

10. A golf comprising a core, an intermediate layer, and a coyer, in which at a boundary between the intermediate layer and the cover, convex ribs having a length greater than its width are arranged in a network pattern on one of either said intermediate layer or cover such that the convex ribs intrude into the other of said intermediate layer or cover; and one of either said intermediate layer or cover having the convex ribs is made harder than the other of said intermediate layer or cover which receives the convex ribs; and cutaway portions defining flow passages through which material flows during molding are formed between opposite ends of the convex ribs.

11. The golf ball according to claim 10, wherein the cutaway portions are formed such that the ribs do not intersect each other and do not form any closed circle.

12. The golf ball according to claim 10, wherein the cutaway portions has a width of 0.5 to 10.0 mm.

13. The golf ball according to claim 10, wherein the ribs have a width of 0.3 to 2.5 mm and a length of 3.0 to 15.0 mm.

14. The golf ball according to claim 10, wherein one of either said intermediate layer or cover having the convex ribs has a Shore D hardness of 58 or greater; and the difference in hardness between one of either said intermediate layer or cover having the convex ribs and the other of said intermediate layer or cover which receives the convex ribs is 5 or greater in Shore D hardness.

15. The golf ball according to claim 10, wherein the convex ribs are formed on the inner surface of the cover, or on the outer surface of the intermediate layer.

16. The golf ball according to claim 10, wherein the convex ribs are formed in arrangement such that when a regular octahedron is assumed on having ribs, and when in each spherical triangle of the regular octahedron, each apex is represented by A, the center is represented by B, the midpoint of each side is represented by C, and the midpoint of a line connecting the center B and each apex A is represented by D, the rib is formed along each of a line between point A and point D, a line between point B and point D, and a line between point C and point D.

17. The golf ball according to claim 10, wherein the convex ribs are formed in arrangement such that when a regular icosahedron is assumed on having ribs, and when in each spherical triangle of the regular icosahedron, each apex is represented by E and the midpoint of each side is represented by F, the rib is formed along each of a line between point E and point F and a line between point F and another point F.

18. The golf ball according to claim 10, wherein the ribs have a width of 0.3 to 2.5 times thickness of having the ribs, the thickness excluding the height of ribs.

* * * * *